US011242976B2

(12) United States Patent
Howard et al.

(10) Patent No.: US 11,242,976 B2
(45) Date of Patent: Feb. 8, 2022

(54) LASER NIGHTLIGHT

(71) Applicant: Mary Elle Fashions, Inc., St. Louis, MO (US)

(72) Inventors: Kenneth A. Howard, Creve Coeur, MO (US); Matthew S. Smith, St. Charles, MO (US)

(73) Assignee: Mary Elle Fashions, Inc., St. Louis, MO (US)

( * ) Notice: Subject to any disclaimer, the term of this patent is extended or adjusted under 35 U.S.C. 154(b) by 0 days.

(21) Appl. No.: 16/553,771

(22) Filed: Aug. 28, 2019

(65) Prior Publication Data

US 2020/0072438 A1 Mar. 5, 2020

Related U.S. Application Data

(60) Provisional application No. 62/723,506, filed on Aug. 28, 2018.

(51) Int. Cl.

| | |
|---|---|
| ***F21V 5/04*** | (2006.01) |
| ***F21V 23/02*** | (2006.01) |
| ***F21V 23/06*** | (2006.01) |

(52) U.S. Cl.

CPC ..... *F21V 5/043* (2013.01); *F21V 23/023* (2013.01); *F21V 23/06* (2013.01)

(58) Field of Classification Search

CPC ..... F21S 8/035; F21V 5/043

See application file for complete search history.

(56) References Cited

U.S. PATENT DOCUMENTS 5,757,111 A * 5/1998 Sato ..... F21V 13/14 313/111
2006/0007709 A1* 1/2006 Yuen ..... F21S 8/035 362/641
2006/0250802 A1* 11/2006 Herold ..... B60Q 1/2657 362/362

(Continued)

FOREIGN PATENT DOCUMENTS

WO WO-2018016918 A1 * 1/2018 ..... F21V 29/70

*Primary Examiner* — Julie A Bannan

(74) *Attorney, Agent, or Firm* — Stinson LLP

(57) ABSTRACT

A laser nightlight is disclosed. A laser nightlight includes a base, an electrical prong adapted to be inserted into an electrical outlet wherein the electrical prong is secured to and projects from the base; and a power supply circuit coupled to the electrical prong and contained within the base. A laser mounted within the base and coupled to the power supply circuit is adapted to produce a laser beam through an output. A lens is secured to the base and is positioned to cover the output of the laser. The output of the laser is pointed at a spot on the lens, and a portion of the lens at the spot may be opaque, faceted or cloudy, or may comprise a diffuser. A portion of the lens where the output of the laser points may contain an image and a light pattern corresponding to the image may be produced when the laser beam illuminates the image. The lens may be formed from shatterproof glass, clear glass or quartz. The lens may be sealed to the base. The lens may have a cylindrical length and the output of the laser may be aligned with the lens to produce the laser beam down a central axis of the lens. The laser may produce a red or green laser beam.

19 Claims, 1 Drawing Sheet

(56) References Cited

U.S. PATENT DOCUMENTS

| | | | | |
|---|---|---|---|---|
| 2008/0074873 | A1* | 3/2008 | Lin | F21S 8/035 362/235 |
| 2015/0098206 | A1* | 4/2015 | Pickard | F21K 9/23 362/84 |
| 2016/0211682 | A1* | 7/2016 | Chien | H02J 7/02 |
| 2016/0223173 | A1* | 8/2016 | Chauvet | F21V 21/116 |
| 2019/0101246 | A1* | 4/2019 | Wang | F21K 9/60 |
| 2019/0234564 | A1* | 8/2019 | Han | F21K 9/27 |

* cited by examiner

LASER NIGHTLIGHT

CROSS REFERENCE TO RELATED APPLICATION

This application claims the benefit of U.S. Provisional Patent Application Ser. No. 62/723,506 filed on Aug. 28, 2018, the disclosure of which is incorporated herein by reference in its entirety.

FIELD OF THE INVENTION

The present invention generally relates to nightlights and in particular to nightlights that use a low power laser for the source of illumination. The lens for the nightlight may be strengthened and sealed to protect against the lens breaking or falling off and potentially causing an eye injury.

BACKGROUND OF THE INVENTION

Nightlights illuminated with incandescent bulbs or LED lights are well known electrical devices in common use. The light emanating from these devices is incoherent light and does not form visible beams and other aesthetic effects.

SUMMARY OF THE INVENTION

The present invention concerns a nightlight containing a laser for providing the source of illumination and pleasing aesthetic effects.

In accordance with one aspect, there is provided a laser nightlight including a base, an electrical prong adapted to be inserted into an electrical outlet wherein the electrical prong is secured to and projects from the base; and a power supply circuit coupled to the electrical prong and contained within the base. A laser mounted within the base and coupled to the power supply circuit is adapted to produce a laser beam through an output. A lens is secured to the base and is positioned to cover the output of the laser. The output of the laser is pointed at a spot on the lens, and a portion of the lens at the spot may be opaque, faceted or cloudy, or may comprise a diffuser. A portion of the lens where the output of the laser points may contain an image and a light pattern corresponding to the image may be produced when the laser beam illuminates the image. The lens may be formed from shatterproof glass, clear glass or quartz. The lens may be sealed to the base. The lens may have a cylindrical length and the output of the laser may be aligned with the lens to produce the laser beam down a central axis of the lens. The laser may produce a red or green laser beam.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
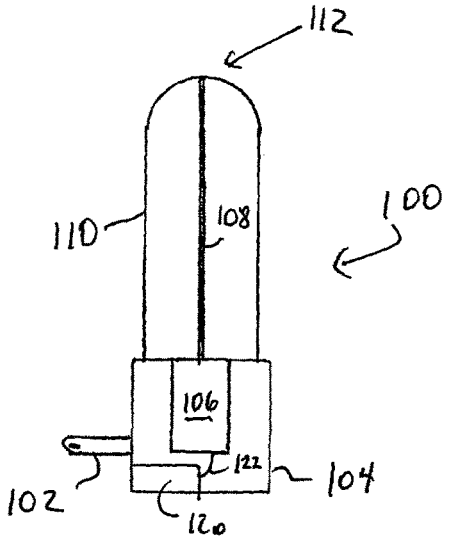
FIG. 1 shows a laser nightlight.

FIG. 1 shows a laser nightlight 100. Nightlight 100 is powered through standard household voltage via electrical prongs 102. Nightlight 100 includes a base 104. Electrical prongs 102 are adapted to be inserted into an electrical outlet wherein the electrical prong is secured to and projects from the base 104. A power supply circuit 120 of conventional design is coupled to the electrical prong 102 and is contained within the base 104. A laser 106 is mounted within the base 104 and is coupled to the power supply circuit 120 via a conductor 122 for powering the laser 106. The laser 106 is adapted to produce a laser beam 108 through its output. A lens 110 is secured to the base 104 and is positioned to cover the output of the laser 106.

The output of the laser 106 is pointed at a spot 112 on the lens 110. A portion of the lens 110 at the spot 112 may be opaque or cloudy. A portion of the lens 110 at the spot 112 may be faceted and reflect some light back in the direction of the laser 106 and/or may allow some light to pass through the lens 110 at the spot 112, depending on the aesthetic effect to be achieved. A portion of the lens 110 at the spot 112 may comprise a diffuser for allowing some light to pass through the lens 110 at the spot 112, again, depending on the aesthetic effect to be achieved. A portion of the lens 110 at the spot 112 may contain an image and a light pattern corresponding to the image may be produced when the laser beam illuminates the image.

As seen in FIG. 1, the lens 110 preferably comprises a cylindrical length wherein the output of the laser 106 is aligned with the lens 110 to produce the laser beam 108 down a central axis of the lens 110. Other shapes of lenses could be used within the scope of the invention. The laser 106 may produce a red or green laser beam 108. The lens 110 may be formed from shatterproof glass, clear glass, quartz, or similar hardened material so that it is not easily broken. The lens 110 is preferably sealed to the base 104 through a connection sufficient to withstand physical impacts in use.

Figure 2:
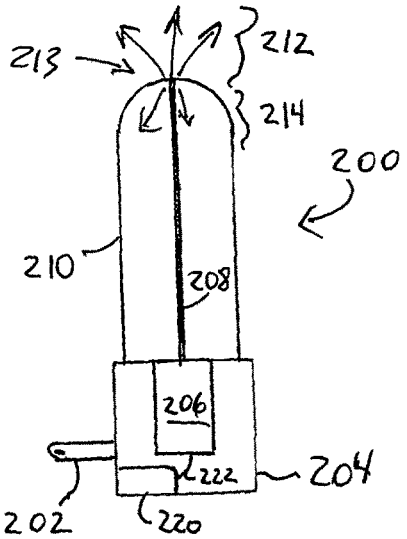
FIG. 2 shows a laser nightlight.

FIG. 2 shows a laser nightlight 200. Nightlight 200 is powered through standard household voltage via electrical prongs 202. Nightlight 200 includes a base 204. Electrical prongs 202 are adapted to be inserted into an electrical outlet wherein the electrical prong is secured to and projects from the base 204. A power supply circuit 220 of conventional design is coupled to the electrical prong 202 and is contained within the base 204. A laser 206 is mounted within the base 204 and is coupled to the power supply circuit 220 via a conductor 222 for powering the laser 206. The laser 206 is adapted to produce a laser beam 208 through its output. A lens 210 is secured to the base 204 and is positioned to cover the output of the laser 206.

The output of the laser 206 is pointed at a spot 213 on the lens 210. A portion of the lens 210 at the spot 213 may be opaque or cloudy. A portion of the lens 210 at the spot 213 may be faceted and reflect some light 214 back in the direction of the laser 206 and/or may allow some light 212 to pass through the lens 210 at the spot 213, depending on the aesthetic effect to be achieved. A portion of the lens 210 at the spot 213 may comprise a diffuser for allowing some light 212 to pass through the lens 210 at the spot 213, again, depending on the aesthetic effect to be achieved. A portion of the lens 210 at the spot 213 may contain an image and a light pattern corresponding to the image may be produced when the laser beam illuminates the image.

As seen in FIG. 1, the lens 210 preferably comprises a cylindrical length wherein the output of the laser 206 is aligned with the lens 210 to produce the laser beam 208 down a central axis of the lens 210. Other shapes of lenses could be used within the scope of the invention. The laser 206 may produce a red or green laser beam 208. The lens 210 may be formed from shatterproof glass, clear glass, quartz, or similar hardened material so that it is not easily broken. The lens 210 is preferably sealed to the base 204 through a connection sufficient to withstand physical impacts in use.

Having provided this detailed description, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above systems without departing from the scope of the invention, it is intended that all matter contained in the above description and shown in the accompanying drawings shall be interpreted as illustrative and not in a limiting sense.

What is claimed is:

1. A nightlight comprising:

a base;

an electrical prong adapted to be inserted into an electrical outlet wherein the electrical prong is secured to and projects from the base;

a power supply circuit coupled to the electrical prong and contained within the base;

a laser mounted within the base and coupled to the power supply circuit, the laser being adapted to produce a laser beam through an output;

a lens secured to the base and positioned to cover the output of the laser, the lens comprising a single structure extending from the base over a central axis of the lens, a spot being disposed on the lens in the path of the laser beam to alter the laser beam, wherein the spot has a dimension corresponding to a dimension of the laser beam; and wherein the output of the laser is pointed at a spot on the lens;

a portion of the lens at the spot contains an image; and a light pattern corresponding to the image is produced when the laser beam illuminates the image.

2. The nightlight of claim 1 wherein the output of the laser is pointed at the spot on the lens, and wherein a portion of the lens at the spot is opaque.

3. The nightlight of claim 1 wherein the output of the laser is pointed at the spot on the lens, and wherein a portion of the lens at the spot is faceted and reflects some light back in the direction of the laser.

4. The nightlight of claim 1 wherein the output of the laser is pointed at the spot on the lens, and wherein a portion of the lens at the spot is faceted and allows some light to pass there through.

5. The nightlight of claim 1 wherein the output of the laser is pointed at the spot on the lens, and wherein a portion of the lens at the spot is cloudy.

6. The nightlight of claim 1 wherein the output of the laser is pointed at the spot on the lens, and wherein a portion of the lens at the spot comprises a diffuser for allowing some light to pass there through.

7. The nightlight of claim 1 wherein the lens is formed from shatterproof glass.

8. The nightlight of claim 1 wherein the lens is formed from clear glass.

9. The nightlight of claim 1 wherein the lens is sealed to the base.

10. The nightlight of claim 1 wherein the lens is formed from quartz.

11. The nightlight of claim 1 wherein the lens comprises a cylindrical length and wherein the output of the laser is aligned with the lens to produce the laser beam down a central axis of the lens.

12. The nightlight of claim 1 wherein the laser produces a red laser beam.

13. The nightlight of claim 1 wherein the laser produces a green laser beam.

14. The nightlight of claim 11 wherein the lens is sealed to the base.

15. The nightlight of claim 9 wherein the laser produces a red laser beam.

16. The nightlight of claim 11 wherein the laser produces a red laser beam.

17. The nightlight of claim 9 wherein the laser produces a green laser beam.

18. The nightlight of claim 1 wherein the lens is free of structure on a longitudinally extending inner surface.

19. The nightlight of claim 1 wherein the lens comprises a tubular section extending from the base and a dome section extending from the tubular section over the central axis of the lens, the spot being disposed on the dome section.

* * * * *